United States Patent [19]

Selvi et al.

[11] 4,401,244

[45] Aug. 30, 1983

[54] AUTOMATIC APPARATUS FOR SUPERIMPOSING, FOLDING AND TRANSFERRING PAIRS OF STOCKINGS TO A COLLECTION STATION

[75] Inventors: Fabio Selvi; Giovanni Chietti, both of Florence, Italy

[73] Assignee: C.K.S. S.n.c., Florence, Italy

[21] Appl. No.: 178,718

[22] Filed: Aug. 18, 1980

[30] Foreign Application Priority Data

Sep. 4, 1979 [IT] Italy ..... 25476 A/79

[51] Int. Cl.[3] ..... D06C 15/00

[52] U.S. Cl. ..... 223/37; 223/60; 223/77

[58] Field of Search ..... 223/37, 38, 60, 75, 223/76, 77, 112

[56] References Cited

U.S. PATENT DOCUMENTS

| | | | |
|---|---|---|---|
| 2,722,348 | 11/1955 | Ammon | 223/77 X |
| 2,761,221 | 9/1956 | Berry | 223/76 X |
| 3,333,748 | 8/1967 | Horberg | 223/112 X |
| 3,811,607 | 5/1974 | Glaze | 223/74 |

*Primary Examiner*—Louis Rimrodt

*Attorney, Agent, or Firm*—Oblon, Fisher, Spivak, McClelland & Maier

[57] ABSTRACT

Apparatus for automatically superimposing and folding collants or stockings and transferring the same to packaging. The apparatus comprises a moving chain carrying grippers having the collants leg tips hanging thereon. The chain travels through a narrow loop, at which moving parts are provided and press the two legs of each collant against each other, whereupon a moving member picks up the stockings midway the length thereof, transferring the same as folded up to a collection station.

5 Claims, 7 Drawing Figures

AUTOMATIC APPARATUS FOR SUPERIMPOSING, FOLDING AND TRANSFERRING PAIRS OF STOCKINGS TO A COLLECTION STATION

BACKGROUND OF THE INVENTION

This invention relates to an automatic apparatus for superimposing or pairing, folding and transferring pairs of stockings to a collection station.

No automatic machines are known at present for superimposing or pairing legs of collants, folding the panties along the center or median line, folding over the legs thus superimposed or paired and transferring the collant thus folded to a collection station for packaging thereof.

Neither are automatic machines known for superimposing or pairing socks or stockings in pairs of socks or stockings, then folding them over and transferring them to a collection station for packaging.

SUMMARY OF THE INVENTION

It is the primary object of the present invention to provide an entirely automatic machine for carrying out the above mentioned operations, that is superimposing or pairing two socks or stockings at a time, or the two legs of a collant, folding over the socks or stockings thus superimposed or paired and transferring them to a collection station.

It is another object of the invention to provide a machine which is of a very simple structure, reliable in operation and capable of operating at a high speed.

These and still further objects are achieved by an apparatus having a moving chain provided with stocking supporting grippers at a location of its path said chain forming a very narrow loop. A two by two stocking pairing device is located at said loop and includes two movable walls connected to operating members causing the same to be respectively moved to and away from one another, a movable arm positioned laterally of said chain and in front of said walls and provided with driving means causing the displacement thereof from a position, at which it is clear of the path or travel of said chain, to a position at which it traverses the path or travel of said chain, a picking up device for the pairs of stockings, carried by said movable arm and having a stem movable from a retracted position, at which it is moved away from said two walls, to a position at which it extends to such walls, in which a window or slot is formed for the passage of said stem and pair of stockings thereby drawn and transferred to a collection station, and members for controlling the opening of the two grippers which are located above said walls, as soon as the latter have been moved near each other.

BRIEF DESCRIPTION OF THE DRAWINGS

In order that the structure and characteristics of the apparatus be more clearly understood, an embodiment thereof will now be described as given by mere way of unrestrictive example, with reference to the accompanying drawings, in which.

DETAILED DESCRIPTION OF THE PREFERRED EMBODIMENTS

Figure 1:
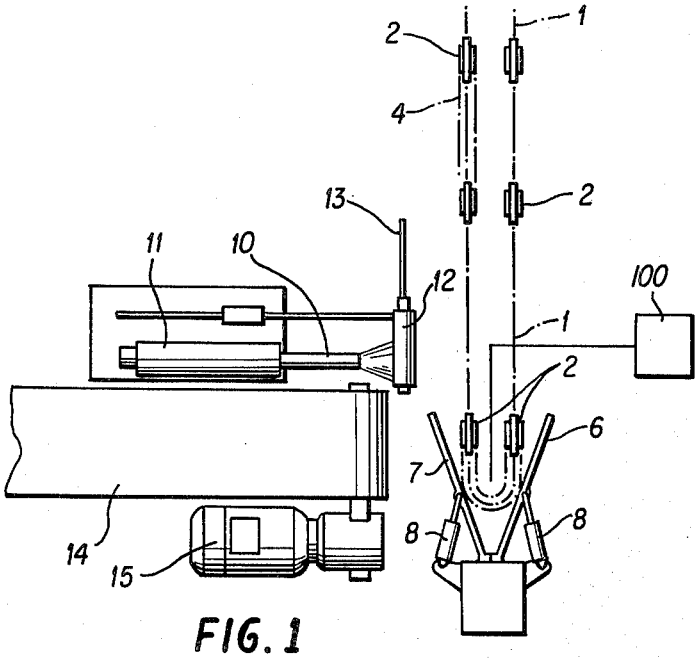
FIG. 1 is a diagrammatic plan view showing the apparatus according to the invention.

A device, according to the invention, includes a moving chain, designated by reference numeral 1 and shown by dashed line in the drawings, such a chain carrying a continuous series of grippers 2 (which, for the sake of simplicity, are not shown in FIGS. 6 and 7), each of which is for supporting the tip of a stocking, which accordingly is downward hanging.

In the drawings, each of the stockings have been shown as comprising a leg 3 of a collant 4 merely outlined in the various figures of the drawings, such a collant having a panties 5 at which the two legs 3 are interconnected.

Figure 2:
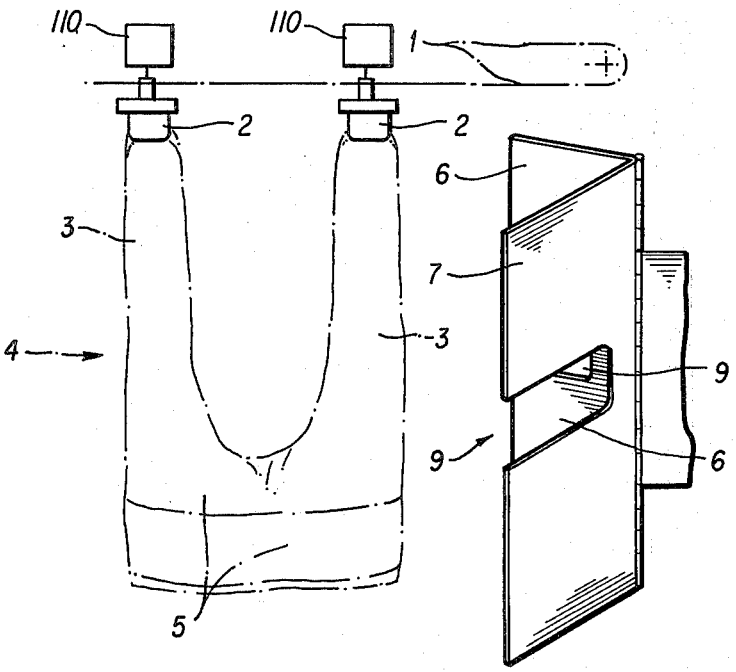
FIG. 2 is a diagrammatic side elevational view, restricted to the representation of the movable walls forming part of the device and a portion of chain adjacent thereto.

As shown in FIGS. 1 and 2, said chain 1 travels through a narrow loop, at which two movable walls 6 and 7 are provided, hinged to each other along a vertical axis, which walls are connected to the rods of two hydraulic or pneumatic pistons 8 (FIG. 1), which can cause the opening or closing thereof, as it will be hereinafter explained.

In each of said two walls 6 and 7, a window or slot 9 is formed, as clearly shown in the drawings.

Laterally of said walls 6 and 7, a movable arm 10 is provided, for example comprising the rod of the piston of a pneumatic or hydraulic cylinder 11 which at its free end facing the chain carries a hydraulic or pneumatic cylinder 12, the movable piston of which carries a rod 13, which can selectively extend to a conveyor belt 14 juxtaposed to said walls 6 and 7 and operated by a motor 15.

Figure 3:
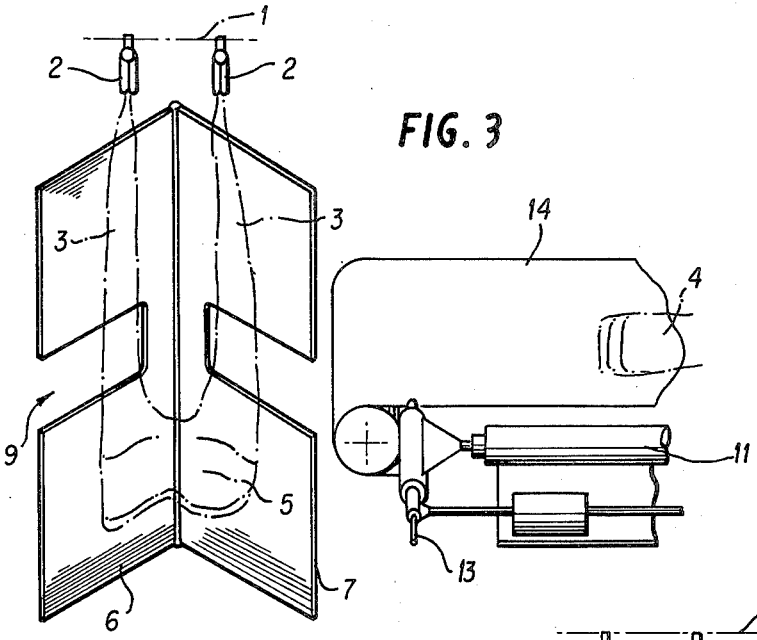
FIG. 3 is a front view of the movable walls forming part of the apparatus, at a stage at which such walls are moved away from each other.

Accordingly, assume that each pair of successive grippers have the two legs 3 of a collant hanging therefrom, as above mentioned. When the two involved grippers are at the loop formed by said chain 1 and correctely located side by side to each other, as particularly shown in FIG. 1, the two legs 3 of the involved collant will be juxtaposed to each other and positioned between the two movable walls 6 and 7, as shown in FIG. 3.

Figure 4:
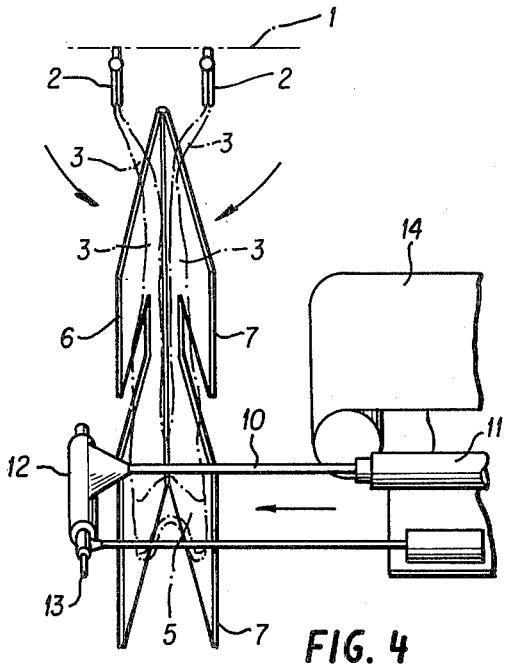
FIG. 4 is a view similar to that of FIG. 3, but with the movable walls being closed.

At this position, an air jet or a movable arm 100 will act on the collant panties 5, urging it to the hinge formed by the two movable walls 6 and 7, while at the same time said two walls will start to move near each other (due to pistons 8), so as to superimpose or pair the two legs 3 of the collant and the two equal portions of the collant panties, as it can be readily understood and as shown in FIG. 4.

During this stage at which said two movable walls start to be closed, the rod 10 of cylinder 11 will be entirely outward projected, thus carrying the cylinder 12 beyond the two walls 6 and 7, still as clearly shown in FIG. 4. At this stage, the rod 13 of cylinder 12 will be completely moved to one side, so as not to interfere with the collant legs positioned between the movable walls.

Figure 5:
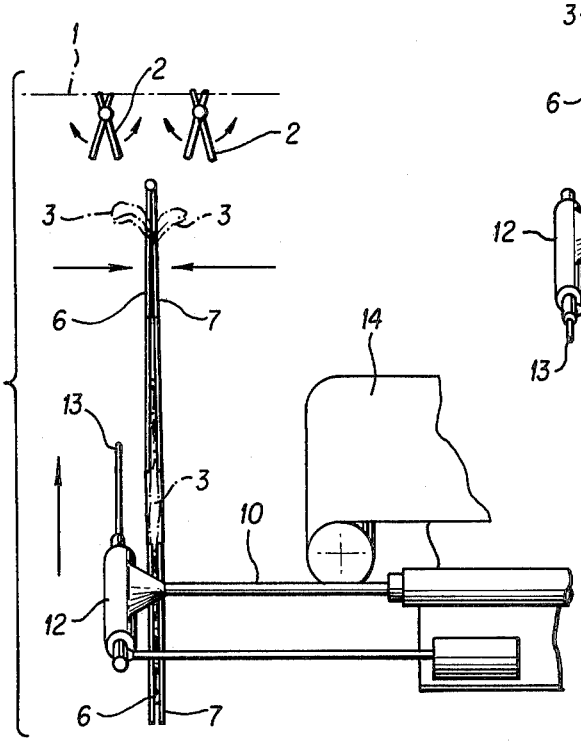
FIG. 5 is a view similar to those of FIGS. 3 and 4, but with the movable walls completely closed and stockings blocked therebetween and superimposed or paired with one another.

At the end of this stage, the two walls 6 and 7 will be completely closed (FIG. 5), very slightly pressing the two superimposed or paired legs and the folded panties of the collant. Now, a device (not shown) (for example, an electromagnetic device) 110 will cause the opening of the two pliers holding the leg tips of the collant blocked or clamped between the movable walls, while at the same time said cylinder 12 will be operated causing the displacement of rod 13 towards said walls, as shown in FIG. 5.

Figure 6:
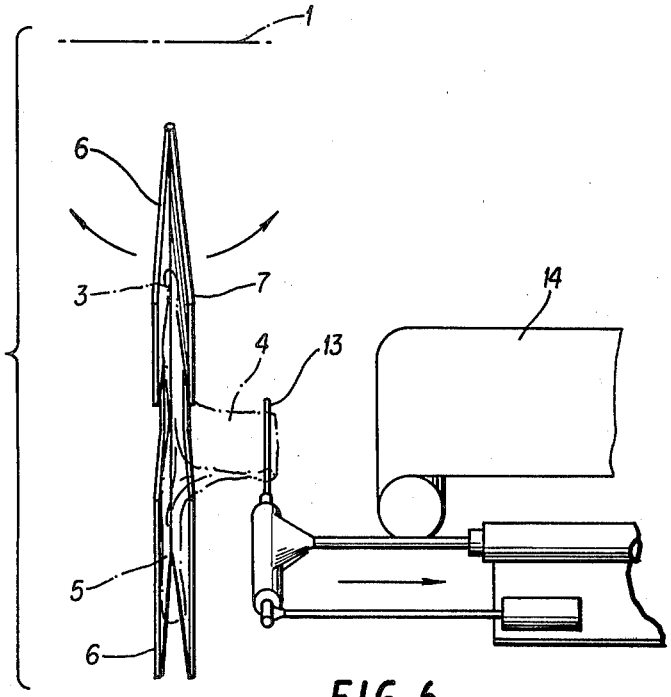
FIG. 6 is a front view of the movable walls at the beginning of the opening thereof and picking up of the pairs of stockings.
Figure 7:
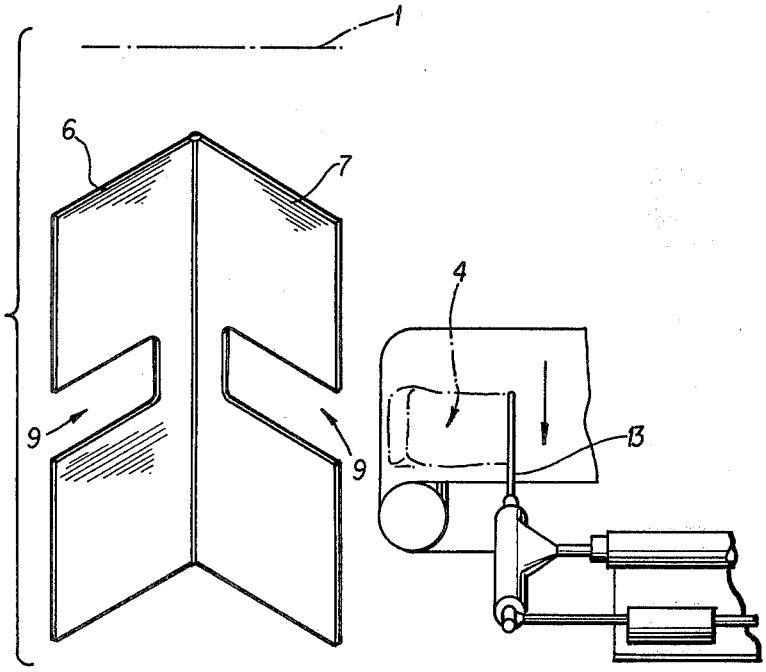
FIG. 7 is a front view of the station for the device comprising the movable walls during the last or final step, at which the transfer of a pair of stockings onto a conveyor belt has occurred.

Now, a return stroke of stem 10 (and hence of cylinder 12) will be started to the original rest position, and during such a movement said rod 13 will pass through the windows or slots 9 formed in said walls 6 and 7, thus hooking or clasping the superimposed or paired legs of the collant, which as a result will be caused to move out of the two walls, the latter simultaneously starting to move away from each other, as shown in FIG. 6.

Then, the rod 13 will complete the transfer of the collant legs substantially folded up at midway or intermediate length thereof onto the conveyor belt 14, which will deliver such a collant to a collection station, such as a packaging station.

The collant, which is laid down on the conveyor belt 14, has its two legs superimposed or paired to each other, and such legs will be folded up, so that said collant is definitely ready for packaging.

At said walls 6 and 7, heating means could be provided, such as hot air jets or electrical resistances or the like, in order that the collant if wet can be thoroughly dried and prefixed, that is ironed, which operation is promoted in that the collant is slightly pressed between said two movable walls 6 and 7.

In the description given with reference to the drawings, the members controlling the movement of the various movable elements have been outlined as comprising rods forming part of hydraulic or pneumatic cylinders, but as apparent such members could be of different type, for example movable members of electrical solenoids, or equivalent mechanical members.

It is also apparent that the superimposed or paired and folded stockings could be unloaded from the stem 13 on a member other than said conveyor belt 14, for example the stockings could be directly inserted in a picking up tunnel.

In the description reference has been made to the folding for the packaging of a collant, but it clearly appears that the apparatus is also suitable to automatic superimposition or pairing and folding of common socks and stockings. It also appears that the forward motion of chain 1 should be of intermittent type, but the stop time, during which two grippers are at side by side relationship at said walls 6 and 7 is very short, that is only few seconds.

From the foregoing it clearly appears that all of the described operations can be carried out at high speed and completely automatically, with the obvious advantages issuing therefrom, while the apparatus being of extremely simple structure and low cost.

What is claimed as new and desired to be secured by Letters Patent of the United States is:

1. An apparatus for pairing, folding and transferring to a collection station pairs of stockings or socks, said apparatus comprising:
   - a movable elongated conveyor means, said conveyor means defining a turn;
   - a plurality of gripper means mounted on said conveyor means;
   - a pair of movable walls, one of said walls being positioned on either side of said conveyor means at said turn, each of said walls including a slot;
   - first means for moving said walls towards and away from one another;
   - a movable arm located at one side of said conveyor means, said arm having a distal end movable between a first position and a second position which traverses the path of said conveyor means;
   - second means for moving said movable arm;
   - pick up means carried by said distal end of said arm, said pick up means including a pick up element movable between a retracted position and an extended position in which said pick up element is able to pass through said slots of said walls as said arm moves between said first and second positions;
   - third means for moving said pick up element; and
   - means for opening and closing said gripper means;
   - whereby stockings held by said gripper means are paired by said walls moving towards one another, and whereby the movement of said arm from said second position to said first position, while said pick up element is extended, draws said stockings through one of said slots so as to fold said stockings and transfer said paired and folded stockings to said collection station.

2. An apparatus according to claim 1 wherein said two walls are hinged to each other along an axis transverse to the direction of movement of said conveyor means and said arm.

3. An apparatus according to claims 1 or 2, wherein said collection station comprises one end of a conveyor belt.

4. An apparatus according to claims 1 or 2, wherein means are provided in front of said two walls for pushing or urging a common portion of the two stockings to a joining line of said two walls.

5. An apparatus according to claims 1 or 2 wherein heating means for the stockings are provided at said movable walls.

* * * * *